US005873753A

United States Patent [19]

Norris, Jr. et al.

[11] Patent Number: 5,873,753

[45] Date of Patent: Feb. 23, 1999

[54] TERMINAL BLOCK HAVING SECONDARY LOCK MEMBER

[75] Inventors: John S. Norris, Jr.; Neal C. DeCicco, both of Hubbard, Ohio

[73] Assignee: Stoneridge, Inc., Alphabet Division, Warren, Ohio

[21] Appl. No.: 910,161

[22] Filed: Aug. 13, 1997

[51] Int. Cl.[6] ..... H01R 13/514

[52] U.S. Cl. ..... 439/752

[58] Field of Search ..... 439/752, 595, 439/752.5, 748

[56] References Cited

U.S. PATENT DOCUMENTS

| | | | |
|---|---|---|---|
| 4,721,862 | 1/1988 | Cooper | 307/10 R |
| 4,950,182 | 8/1990 | Zielinski et al. | 439/595 |
| 5,195,913 | 3/1993 | Shattuck | 439/748 |
| 5,257,951 | 11/1993 | Maeda | 439/752 |
| 5,520,552 | 5/1996 | Seki | 439/595 |

OTHER PUBLICATIONS

Alphabet Fuse Electrical Panel Design, 1993.
Alphabet ISO Relay Electrical Panel Design, 1992.
Alphabet Secondary Lock Design, 1990.
Packard Electric Division 4–Way Fuse Block Design, 1977.

*Primary Examiner*—Steven L. Stephan
*Assistant Examiner*—T. C. Patel
*Attorney, Agent, or Firm*—Benesch, Friedlander, Coplan & Aronoff LLP

[57] ABSTRACT

A terminal block assembly including a terminal block portion and a secondary locking member. The terminal block has a plurality of cavities for housing female terminals and circuit protection devices (e.g., fuses and circuit breakers) having mating male blade terminals The terminal block also includes a secondary lock receiving portion for receiving the secondary locking member. The secondary locking member secures the female terminal within a cavity.

19 Claims, 7 Drawing Sheets

TERMINAL BLOCK HAVING SECONDARY LOCK MEMBER

FIELD OF INVENTION

The present invention generally relates to a terminal block for connecting a circuit protection device (e.g., fuse or circuit breaker) to a terminal, and more particularly to a terminal block having secondary locking means.

BACKGROUND OF THE INVENTION

One problem encountered with prior art terminal blocks is that the unseat force to disconnect a terminal from a terminal block has been insufficient to prevent inadvertent and accidental disconnections. Accordingly, there is a need to more securely connect a terminal to a terminal block. In addition, it is often difficult to be assured that the terminal has traveled the required distance to ensure proper engagement with the terminal block. The present invention addresses these problems, as well as others to provide a secure and reliable connection between terminals and circuit protection devices, such as fuses and circuit breakers.

SUMMARY OF THE INVENTION

According to the present invention there is provided a terminal block for securing a circuit protection device to a terminal.

An advantage of the present invention is the provision of a terminal block having a secondary lock for insuring proper engagement of a terminal in the terminal block.

Another advantage of the present invention is the provision of a terminal block having a secondary lock for increasing the terminal's unseat force.

Still another advantage of the present invention is the provision of a terminal block having a cavity dimensioned to reduce the amount of travel the terminal can move from side to side.

Still other advantages of the invention will become apparent to those skilled in the art upon a reading and understanding of the following detailed description, accompanying drawings and appended claims.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

Figure 1:
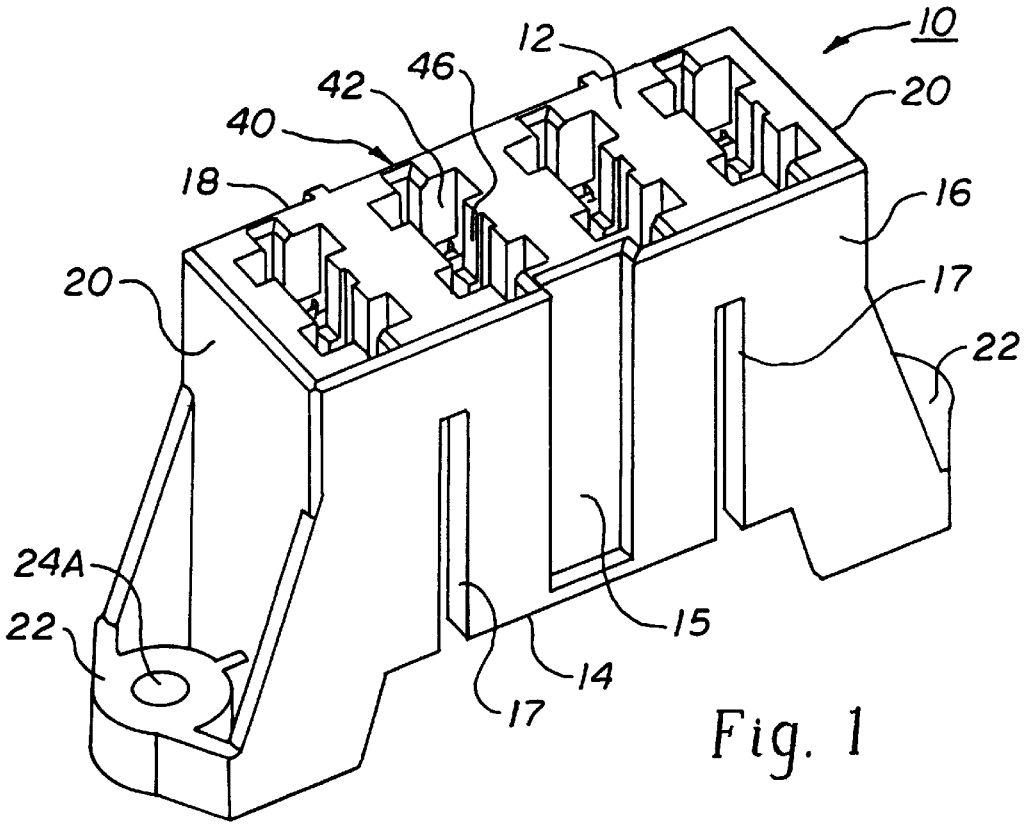
FIG. 1 is a front perspective view of the terminal block according to a preferred embodiment of the present invention, wherein the upper face of the terminal block is shown.
Figure 2:
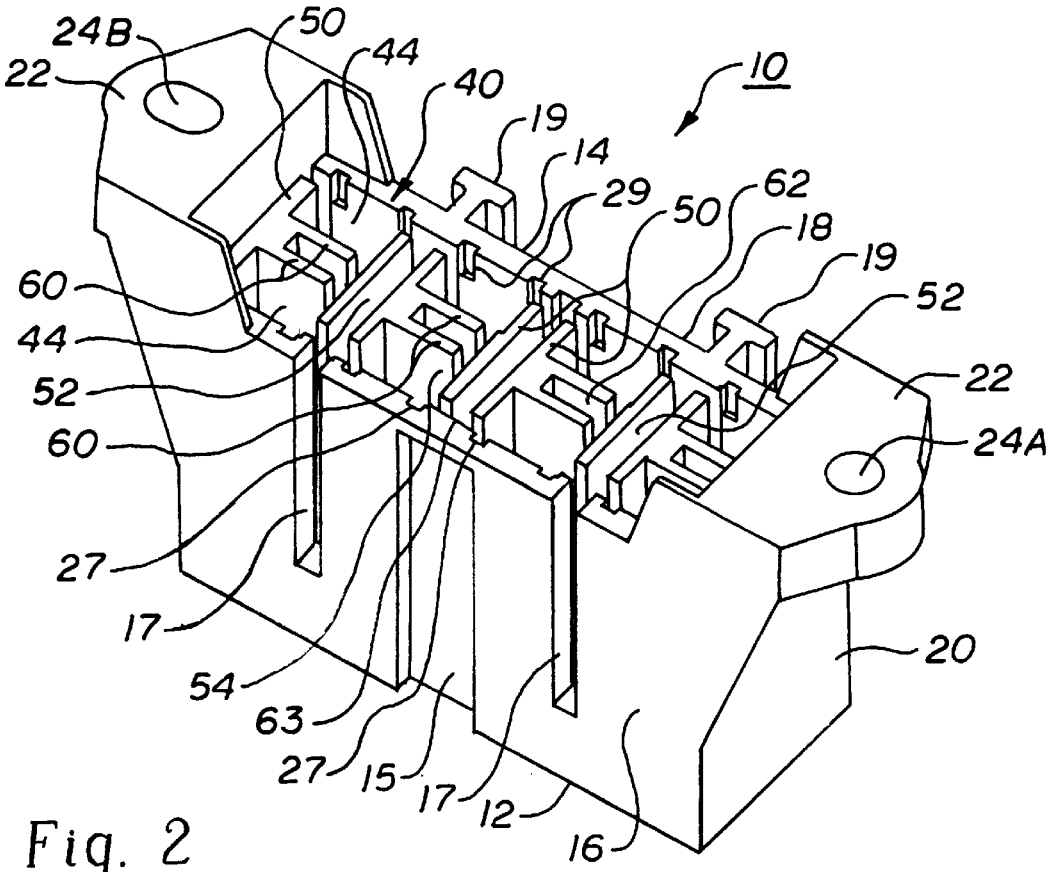
FIG. 2 is a rear perspective view of the terminal block shown in FIG. 1, wherein the upper face of the terminal block is shown.
Figure 3:
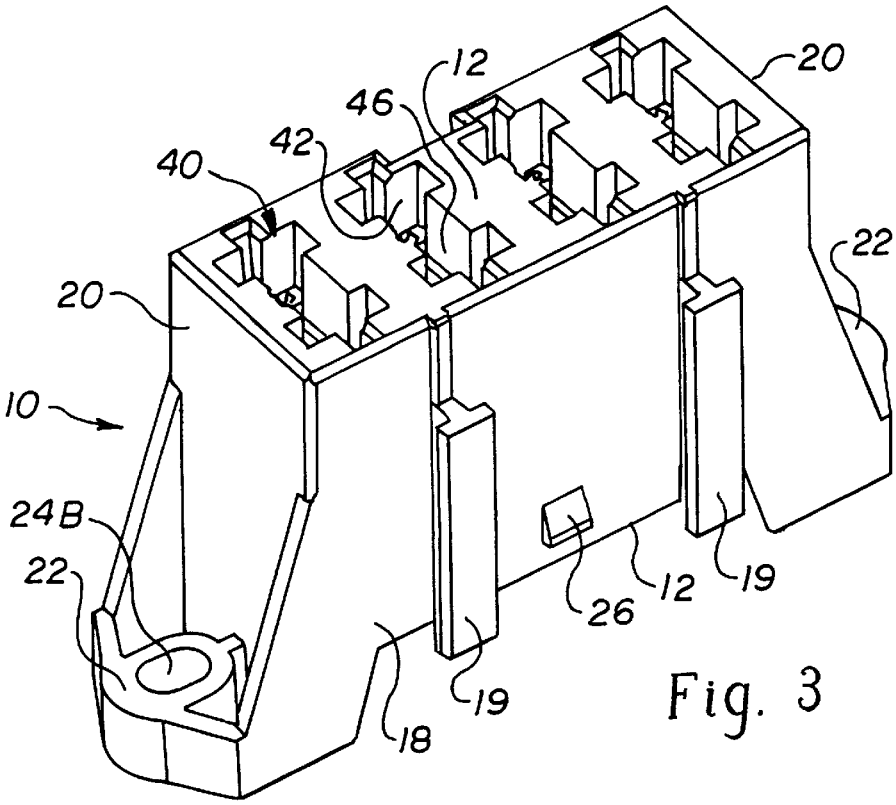
FIG. 3 is a front perspective view of the terminal block shown in FIG. 1, wherein the lower face of the terminal block is shown.

Referring now to the drawings wherein the showings are for the illustrating a preferred embodiment of the invention only and not for purposes of limiting same, FIGS. 1–3 show perspective views of terminal block 10. Terminal block 10 is generally comprised of a front face 12, a rear face 14, an upper face 16, a lower face 18, side walls 20 and lower sections 22. Upper face 16 includes a groove 15 located along the center line thereof, and a pair of slots 17. Slots 17 are dimensioned to receive T-shaped rails 19 of an adjacent terminal block 10, as will be described below. Grooves 27 are formed on the inner surface of upper face 16. Grooves 27 provide a guide path for secondary lock member 100, as will be explained below. Lower face 18 includes a protuberance 26 located along the center line thereof, and a pair of T-shaped rails 19. As noted above, T-shaped rails 19 are dimensioned to be received within slots 17 of an adjacent terminal block 10. In this way, two or more terminal blocks 10 can be joined together. Grooves 29 are formed in the inner surface of lower face 18. Grooves 29, along with grooves 27, provide a guide path for secondary lock member 100. Lower sections 22 extend outward from side walls 20. Lower sections 22 include holes 24A and 24B. Hole 24B is somewhat elongated. Holes 24A and 24B allow terminal block 10 to be releasably mounted to a support surface, using a fastener (e.g. a screw, bolt or the like).

Figure 4:
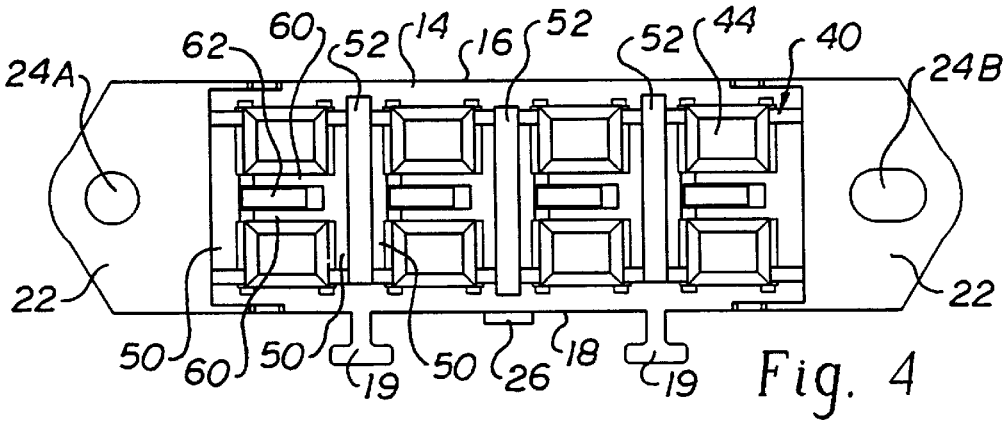
FIG. 4 is a rear plan view of the terminal block shown in FIG. 1.
Figure 5:
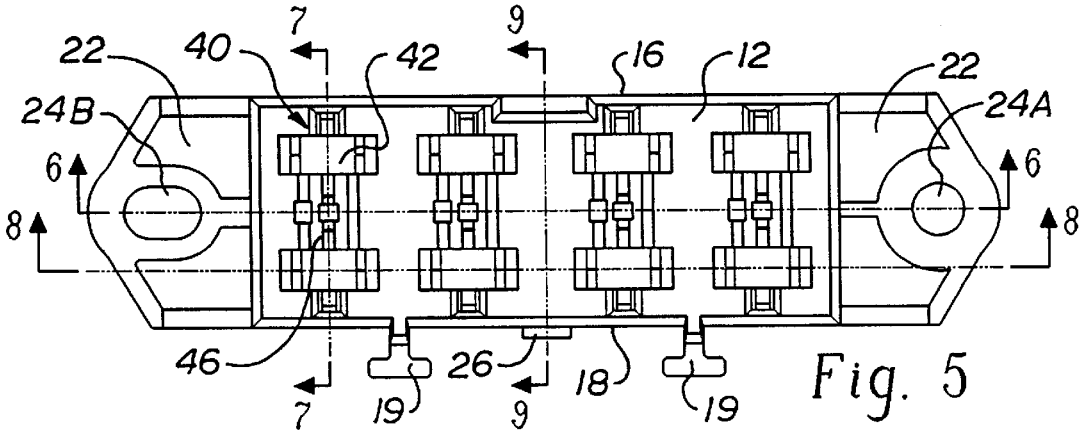
FIG. 5 is a front plan view of the terminal block shown in FIG. 1.
Figure 8:
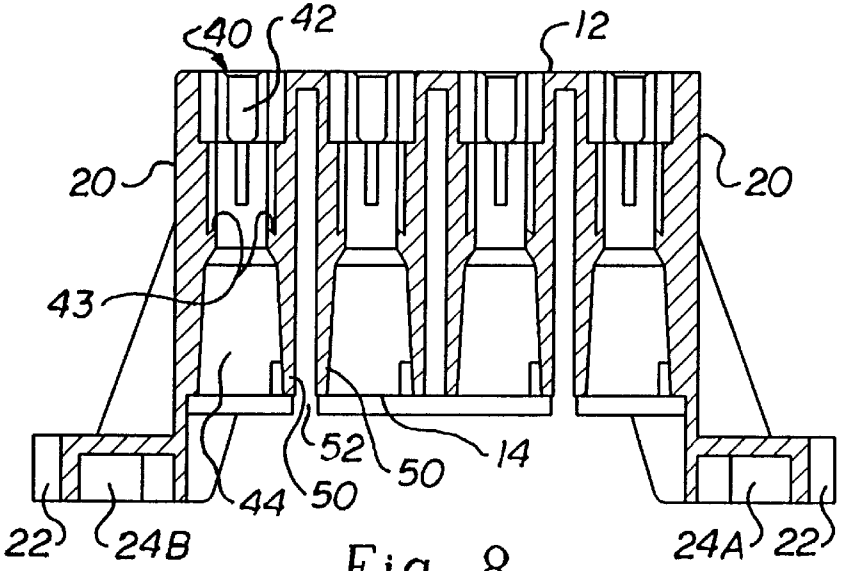
FIG. 8 is a sectional view of the terminal block, taken along line 8—8 of FIG. 5.
Figure 9:
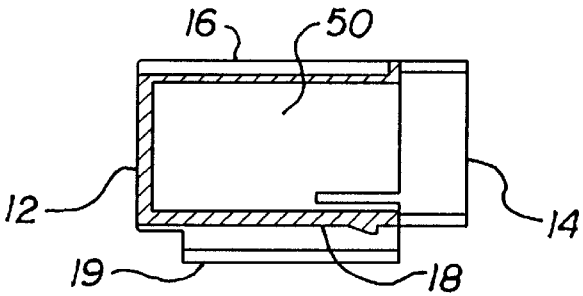
FIG. 9 is a sectional view of the terminal block, taken along line 9—9 of FIG. 5.
Figure 6:
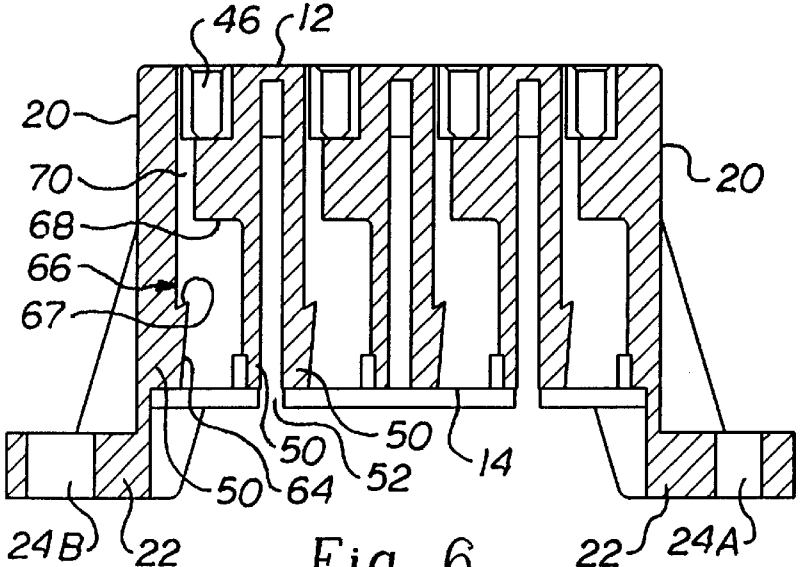
FIG. 6 is a sectional view of the terminal block, taken along line 6—6 of FIG. 5.
Figure 7:
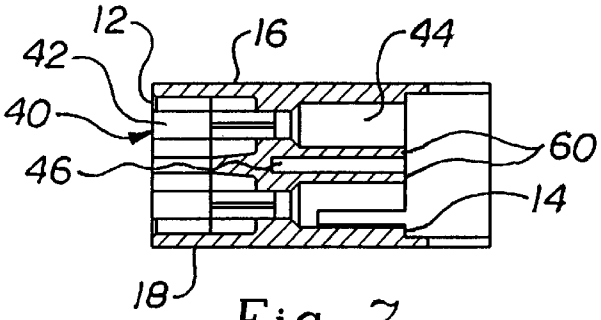
FIG. 7 is a sectional view of the terminal block, taken along line 7—7 of FIG. 5.
Figure 15:
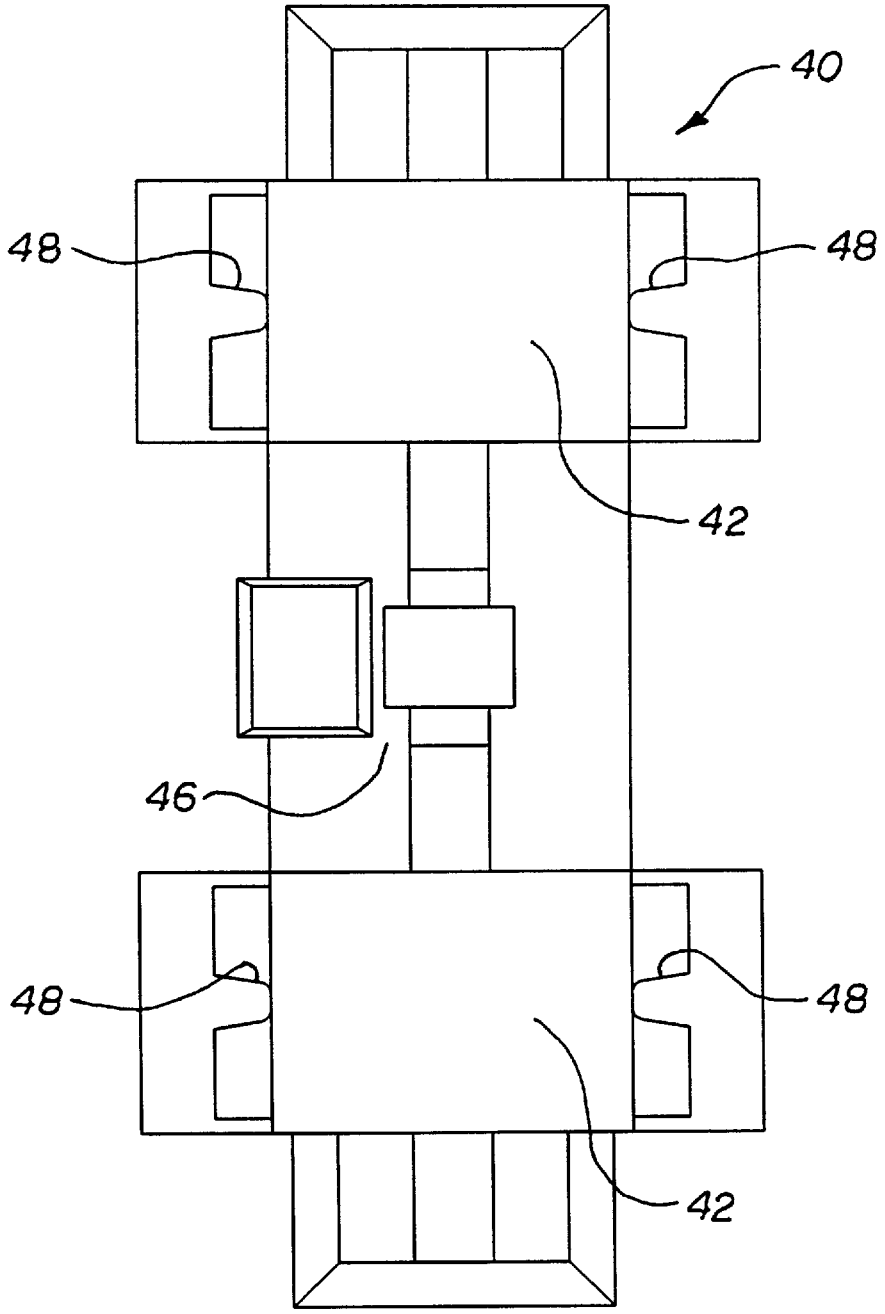
FIG. 15 is an enlarged view of the cavity shown in FIG. 5.

Cavities 40 extend from front face 12 to rear face 14 (FIGS. 7 and 8). Each cavity 40 includes a front opening 42, which is formed in front face 12 (FIGS. 1 and 3). As best seen in FIG. 5, front opening 42 includes a socket 46. Front opening 42 is dimensioned to receive a circuit protection device, such as a blade-type fuse or circuit breaker (not shown). Each cavity 40 also includes a rear opening 44, which is formed in rear face 14 (FIG. 2). As best seen in FIG. 4, rear opening 44 is dimensioned to receive an individual female terminal (FIG. 16) or a female terminal which is part of a bus bar (FIG. 17). The terminal is adapted to receive one of a male blade terminal of a blade-type circuit protection device, when it is inserted into front opening 42. A corner 43 is formed inside cavity 40 to engage with lock tangs of the terminal, as will be explained below. In addition, cavity 40 includes protuberances 48 (FIG. 15), which are engageable with a portion of the terminal to reduce side-by-side travel of the terminal. This is of particular significance in high vibration environments where degradation of the connection between the terminal and a circuit protection device is a problem.

Cavity 40 is defined by a plurality of vertical walls 50, a plurality of horizontal walls 60 and upper and lower faces 16,18, as best seen in FIGS. 4 and 6–8. Vertical walls 50 also define a plurality of vertical cavities 52, as best seen in FIGS. 4 and 8. A slot 54 is provided at the lower end of vertical walls 50. Horizontal walls 60, together with vertical walls 50, define a plurality of horizontal cavities 62, which will be described with reference to FIG. 6. Horizontal cavities 62 include a slanted wall 64. Each slanted wall 64, together with a vertical wall 50, define an L-shaped shoulder 66. It should be noted that L-shaped shoulder includes a surface 67 extending generally perpendicular to the surface of vertical wall 50. Horizontal cavities 62 also include a back wall 68. Shoulder 66 engages with a secondary lock 100 to secure the engagement of the terminals, as will be described below. Horizontal slots 63 are formed in horizontal cavity 62 for properly orienting secondary lock member 100 in the terminal, as will be explained in detail below.

Figure 11:
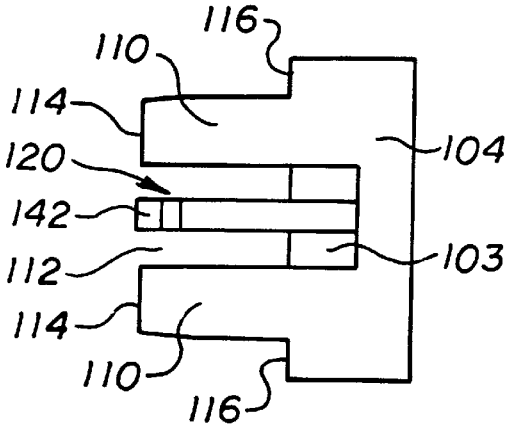
FIG. 11 is a rear plan view of the secondary lock member shown in FIG. 10.
Figure 10:
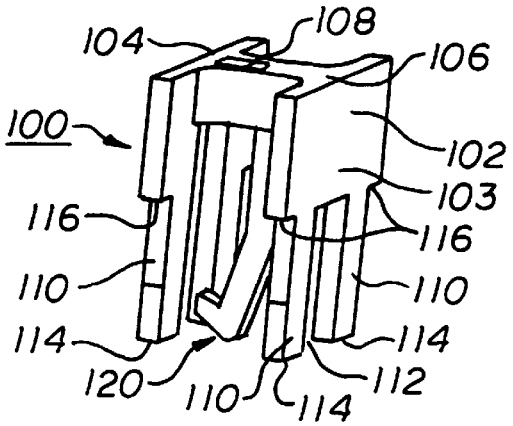
FIG. 10 is a perspective view of the secondary lock member according to a preferred embodiment of the present invention.
Figure 13:
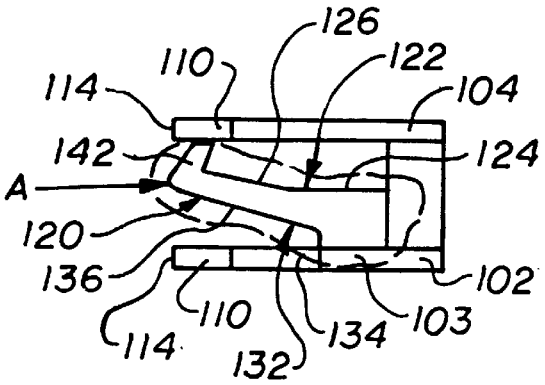
FIG. 13 is a side plan view of the secondary lock member shown in FIG. 10.
Figure 12:
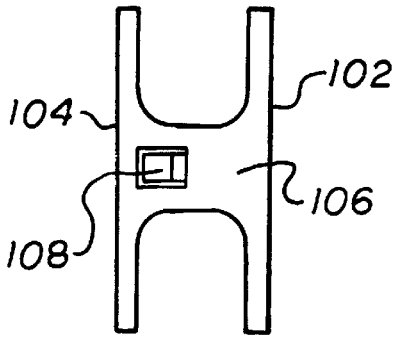
FIG. 12 is a top plan view of the secondary lock member shown in FIG. 10.
Figure 14:
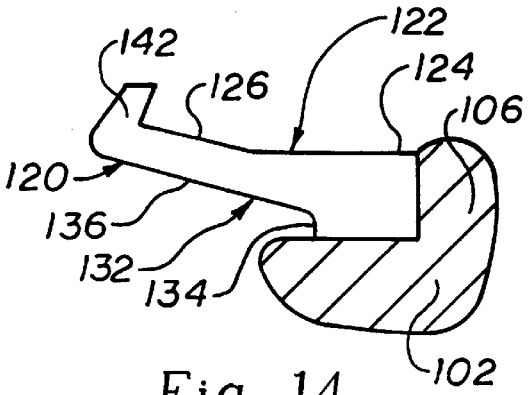
FIG. 14 is an enlarged view of section A shown in FIG. 13.

H-shaped secondary lock member 100 mates with terminal block 10 to secure a terminal thereto. Secondary lock member 100 will now be described with reference to FIGS. 10–14. Secondary lock member 100 is basically comprised of a generally planar front wall 102, a generally planar rear wall 104, a central wall 106, and a resilient locking hook 120. It should be noted that front wall 102 includes a center portion 103. A pair of arms 110 extend from both front wall 102 and rear wall 104. Each pair of arms 110 define a slot 112. Slot 112 is dimensioned to be receive a pair of horizontal walls 60. In this regard, arms 110 are received within rear openings 44 above and below a horizontal wall 60. Each pair of arms 110 also includes a front edge 114. Front wall 102 and rear wall 104, together with arms 110 define an outer edge 116 (FIGS. 10 and 11). Resilient locking hook 120 extends from the inside surface of both front wall 102 and central wall 106 (FIGS. 13 and 14). Locking hook 120 includes an upper surface 122 and a lower surface 132. Upper surface 122 includes a generally planar portion 124 and an angled portion 126. Lower surface 132 includes a generally planar portion 134 and an angled portion 136. Planar portion 134 defines a front surface, which is generally parallel to central wall 106. Planar portion 134 is integral with central portion 103 (FIG. 13), which strengthens resilient locking hook 120, and reduces the cantilever action. Angled portion 136 extends from planar portion 134. A hook portion 142 is formed at the free end of locking hook 120. Hook portion 142 engages with L-shaped shoulder 66 to secure secondary lock member 100 to terminal block 10, as will be described below. An opening 108 is formed in central wall 106 to facilitate disengagement of secondary lock member 100 from terminal block 10, as will also be explained below.

Engagement of a terminal T (FIGS. 16 and 18) with secondary lock member 100 and the engagement of a bus bar terminal B (FIG. 19) with secondary lock member 100, will now be described in detail. A terminal, either in the form of an individual terminal, or as part of a bus bar, is inserted through the rear opening of cavity 40. Terminals T and B include lateral deflectable lock tangs 162, which engage with corner 43, when the terminal is fully seated. To engage secondary lock member 100 with terminal block 10, arms 110 are inserted into a respective pair of rear openings 44 and the outer edges of arms 110 are appropriately aligned with grooves 27 and 29. At the same time, locking hook 120 of secondary lock member 100 is inserted into horizontal cavity 62. Pressure is applied to secondary lock member 100 to move it forward towards front face 12. Secondary lock member 100 is fully seated when hook portion 142 engages with L-shaped shoulder 66 and the inner face of central wall 106 contacts the rear face 14.

It should be appreciated that horizontal slots 63 formed in horizontal cavity 62 are dimensioned to receive the center portion 103 of front wall 102, when secondary lock member 100 is in the fully seated position. In this regard, resilient locking hook 120 will not engage with shoulder 66 unless it is oriented such that horizontal slots 63 (FIG. 2) receive center portion 103. Accordingly, disorientation of secondary lock member 100 by 180 degrees is avoided, since the secondary lock member will not be fully insertable into the cavity (nor will it appear properly seated), and locking hook 130 will not lock with shoulder 66. In this manner, center portion 103, together with horizontal slots 63, provide an indexing feature.

Figure 16:
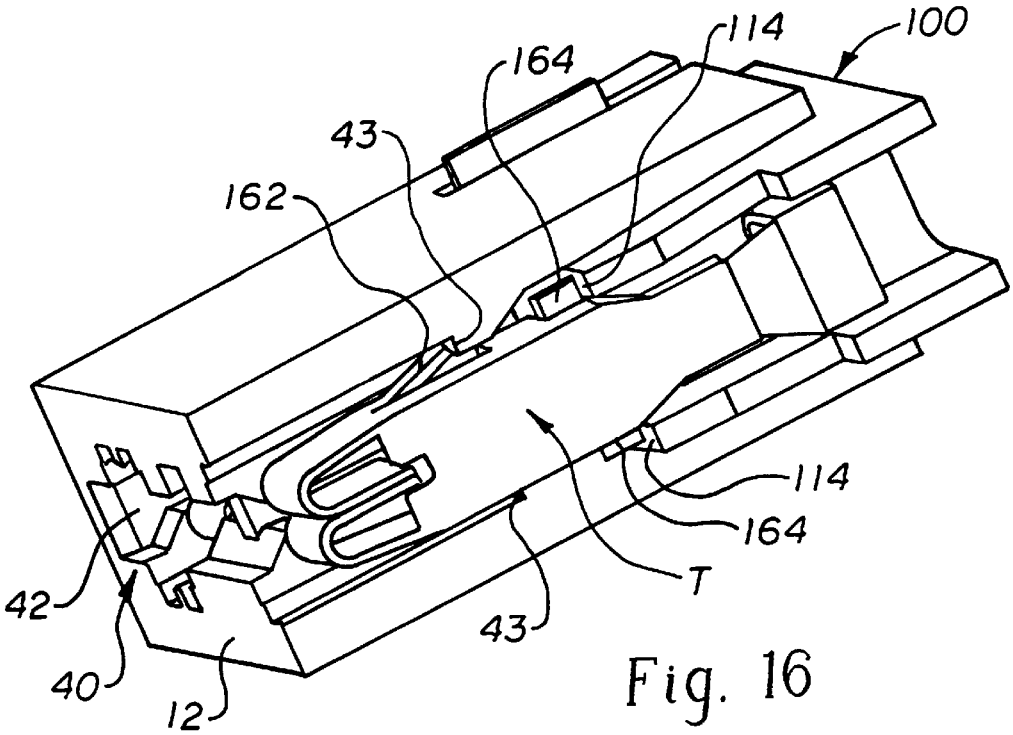
FIG. 16 is a cut-away view of a portion of the terminal block, with an individual terminal secured therein by the secondary lock member shown in FIG. 10.
Figure 17:
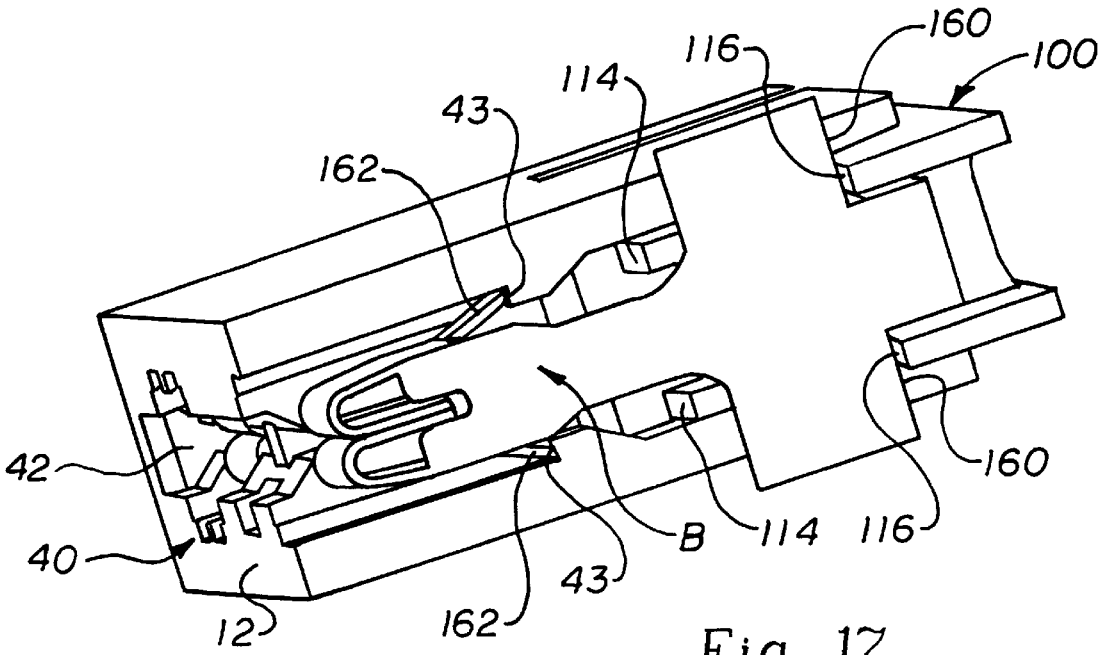
FIG. 17 is a cut-away view of a portion of the terminal block, with a bus bar terminal secured therein by the secondary lock member shown in FIG. 10.
Figure 18:
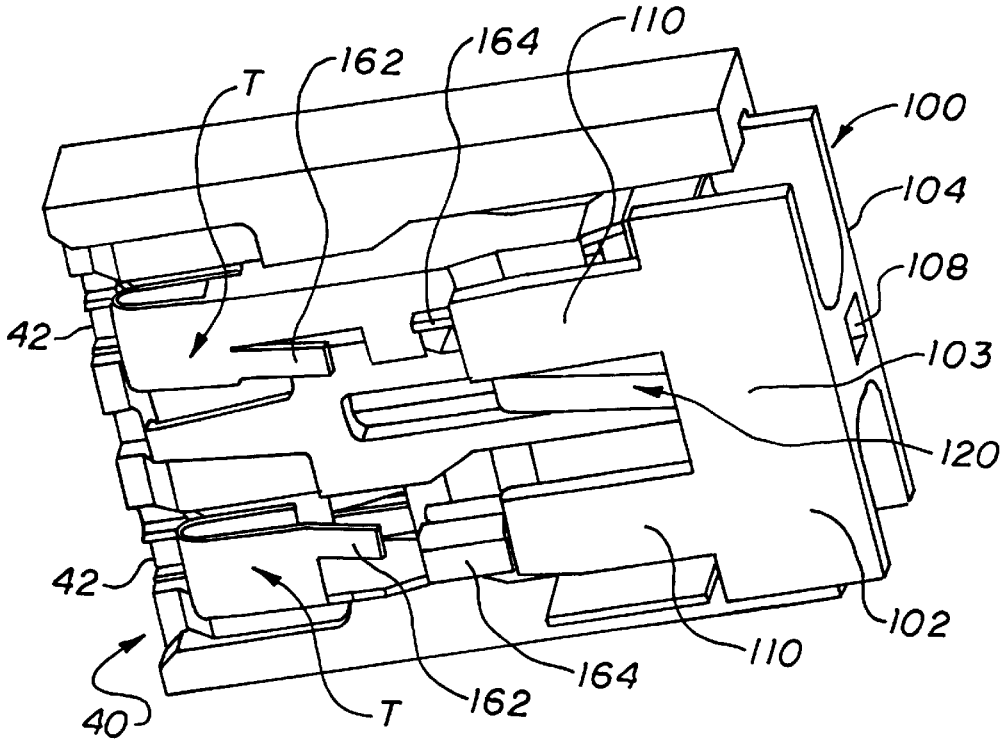
FIG. 18 is a side cut-away view of a portion of the terminal block, with individual terminals secured therein by the secondary lock member shown in FIG. 10.
Figure 19:
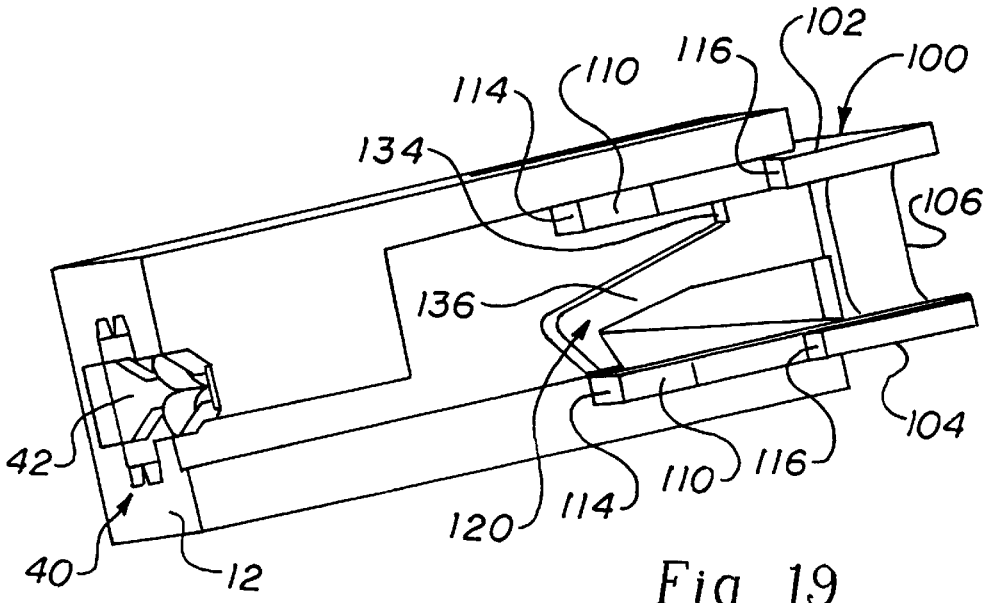
FIG. 19 is a cut-away view of a portion of the terminal block, showing the secondary lock member in a fully seated position.

As secondary lock member 100 is moved to its fully seated position, front edge 114 engages with wings 164 of terminal T (FIGS. 16 and 18). Similarly, outer edge 114 engages with rear edge 160 of bus bar terminal B (FIG. 17). FIG. 18 shows a single secondary lock member 100 securing a pair of individual terminals. FIG. 19 illustrates secondary lock member 100 in a fully seated position with no terminal inside cavity 40.

To release secondary lock member 100 from terminal block 10, an elongated member (not shown) is inserted through opening 108. As a result, hook portion 142 disengages from L-shaped shoulder 66 and secondary lock member 100 is suitably withdrawn from rear openings 44.

It should be appreciated that secondary lock member 100 increases the unseat force necessary to unseat the terminal. Moreover, secondary lock member 100 provides means for verifying that the terminal is in a fully seated position, since in order to engage hook portion 142 with shoulder 66, secondary lock member 100 must push the terminal forward such that lock tangs 162 engage with corners 43 of the terminal block. Accordingly, secondary lock member 100 provides "terminal position assurance."

The invention has been described with reference to a preferred embodiment. Obviously, modifications and alterations will occur to others upon a reading and understanding of this specification. It is intended that all such modifications and alterations be included insofar as they come within the scope of the appended claims or the equivalents thereof.

Having thus described the invention, it is now claimed:

1. A terminal block assembly comprising:

a terminal block including:

a plurality of terminal cavities adapted for receiving an electrical terminal and a mating electrical device, and a plurality of lock cavities having a locking portion adapted for locking the electrical terminal to the terminal block; and secondary locking means adapted for locking the electrical terminal to the terminal block, said secondary locking means including:

first and second wall means joined together by a central wall means extending generally perpendicular to said first and second wall means, first and second pair of arms respectfully extending from said first and second wall means, wherein said first and second pair of arms respectfully define first and second elongated slots, said second slot being longer than said first slot, and resilient locking means engageable with the locking portion, said resilient locking means including a generally planar wall member extending generally parallel to said central wall means.

2. A terminal block assembly according to claim 1, wherein said plurality of lock cavities are located between a pair of said terminal cavities.

3. A terminal block assembly according to claim 1, wherein said locking portion includes shoulder means for receiving said resilient locking means.

4. A terminal block assembly according to claim 1, wherein said terminal cavities are dimensioned to respectively receive said plurality of arms.

5. A terminal block assembly according to claim 1, wherein said terminal block further comprises means for releasably attaching said terminal block to a support structure.

6. A terminal block assembly according to claim 1, wherein said electrical device is a circuit protection device.

7. A terminal block assembly according to claim 1, wherein said terminal block assembly includes indexing means for properly orienting said resilient locking means in relation to said locking portion, said indexing means including said first slot and said generally planar wall member.

8. A terminal block assembly according to claim 7, wherein said indexing means includes a slot formed in said terminal block, said slot dimensioned to receive a portion of said secondary locking means.

9. A terminal block assembly according to claim 1, wherein said terminal cavities include travel limiting means for limiting the lateral travel of the electrical terminal located in said terminal cavity.

10. A terminal block assembly according to claim 9, wherein said travel limiting means includes a plurality of protuberances.

11. A terminal block assembly according to claim 1, wherein said secondary locking means engages with the electrical terminal located in said terminal cavity, said secondary locking means moving the electrical terminal to a fully seated position when said resilient locking means engages with the locking portion.

12. A terminal block assembly according to claim 1, wherein said secondary locking means locks a plurality of the electrical terminals to the terminal block.

13. A terminal block assembly comprising:

a terminal block including:

a plurality of terminal cavities for receiving an electrical terminal and a mating electrical device, and a plurality of lock cavities having a locking portion for locking the electrical terminal to the terminal block, said plurality of lock cavities adapted to receive an associated secondary locking means for locking the electrical terminal to the terminal block, said secondary locking means including:

first and second wall means joined together by a central wall means extending generally perpendicular to said first and second wall means, first and second pair of arms respectfully extending from said first and second wall means, wherein said first and second pair of arms respectfully define first and second elongated slots, said second slot being longer than said first slot, and resilient locking means engageable with the locking portion, said resilient locking means including a generally planar wall member extending generally parallel to said central wall means.

14. A terminal block assembly according to claim 13, wherein said locking portion includes shoulder means for receiving said resilient locking means.

15. A terminal block assembly according to claim 13 wherein said terminal block includes indexing means for properly orienting said resilient locking means in relation to said looking portion, said indexing means including said first slot and said generally planar wall member.

16. A terminal block assembly according to claim 15, wherein said indexing means includes a slot formed in said terminal block, said slot dimensioned to receive a portion of said secondary locking means.

17. A terminal block assembly according to claim 13, wherein said terminal cavities include travel limiting means for limiting the lateral travel of the electrical terminal located in said terminal cavity.

18. A terminal block assembly according to claim 17, wherein said travel limiting means includes a plurality of protuberances.

19. A terminal block assembly according to claim 13, wherein said secondary locking means is engageable with the electrical terminal located in said terminal cavity, said secondary locking means adapted to move the electrical terminal to a fully seated position when said resilient locking means engages with the locking portion.

* * * * *